US007273426B2

(12) United States Patent
Sato et al.

(10) Patent No.: US 7,273,426 B2
(45) Date of Patent: Sep. 25, 2007

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 195 days.

(21) Appl. No.: 11/148,340

(22) Filed: Jun. 9, 2005

(65) Prior Publication Data

US 2006/0281583 A1 Dec. 14, 2006

(51) Int. Cl.
*A63B 37/12* (2006.01)

(52) U.S. Cl. ..... 473/383

(58) Field of Classification Search ..... 473/378–385; D21/707–709

See application file for complete search history.

(56) References Cited

U.S. PATENT DOCUMENTS

2007/0026971 A1* 2/2007 Aoyama et al. ..... 473/378

FOREIGN PATENT DOCUMENTS

JP 10-147097 A 6/1998
JP 2004-243033 A 9/2004

OTHER PUBLICATIONS

Udo Machat, Th GOlf Ball Book, Sport Images, pp. 47, 54, 55.*

* cited by examiner

*Primary Examiner*—Raeann Trimiew
(74) *Attorney, Agent, or Firm*—Sughrue Mion Pllc.

(57) ABSTRACT

A golf ball which has markings of letters or figures on its surface with concave parts and/or convex parts, wherein the markings manifest themselves with depressions and/or grooves having a substantially uniform depth from the surface. The markings are clearly visible.

8 Claims, 4 Drawing Sheets

GOLF BALL

BACKGROUND OF THE INVENTION

The present invention relates to a golf ball which has markings (such as letters and figures) on its surface. More particularly, the present invention relates to a golf ball which can be produced with substantially zero percent defective in the process of marking during its production.

A golf ball usually has on its surface a logo mark showing its product name or numeral in one or more colors. A conventional way to form such markings is by direct printing (pad printing), transfer printing (stamping on a transfer film), or thermal transfer printing (that employs a transfer film composed of a base film and an ink layer representing markings). What is common to all of these marking methods is the use of printing ink containing organic or inorganic pigments and the application of external pressure.

Unfortunately, it is difficult to apply a uniform pressure to the surface of a golf ball which, unlike a smooth spherical surface, has a large number of surface irregularities on account of densely arranged dimples. Uneven printing or blurred printing occurs in the bottoms of dimples, giving rise to markings with unclear boundaries.

SUMMARY OF THE INVENTION

The present invention was completed in view of the foregoing. It is an object of the present invention to provide a golf ball which keeps sharp and durable markings (without conventional ink involving many problems as mentioned above) free of adverse effect on the aerodynamic performance due to surface irregularities (such as dimples) on its surface.

In order to achieve the above-mentioned object, the present inventors carried out extensive studies, which led to the finding that markings (of letters or figures) which are made by depression with a substantially uniform depth (from the ball surface) on the concave part and/or convex part of the ball surface instead of using conventional ink containing organic or inorganic pigments, keep their clearness throughout the life of the ball without adverse effect on the ball's aerodynamic performance. The present invention is based on this finding.

The first aspect of the present invention is directed to a golf ball which has markings of letters or figures on its surface with concave parts and/or convex parts. The markings manifest themselves with depressions having a substantially uniform depth from the surface.

The golf ball in its preferred embodiment according to the first aspect of the present invention is characterized by any of the following three features.

(i) The ball has a large number of dimples and the depressions are formed on the walls of the dimples and over the land existing between adjacent dimples.

(ii) The ball has on its surface a large number of non-circular dimples (or concave parts) defined by edges extending with a cross section whose width and height are substantially the same, and the depressions are formed on the walls of the dimples (or concave parts) and over the lands adjacent to them.

(iii) The depressions forming the markings have a depth no larger than 0.12 mm.

The second aspect of the present invention is directed to a golf ball which has markings of letters or figures on its surface with concave parts and/or convex parts. The markings manifest themselves with grooves having a substantially uniform depth from the surface.

The golf ball in its preferred embodiment according to the second aspect of the present invention is characterized by any of the following three features.

(iv) The ball has a large number of dimples and the markings with grooves are formed on the walls of the dimples and over the land existing between adjacent dimples.

(v) The ball has on its surface a large number of non-circular dimples (or concave parts) defined by edges extending with a cross section whose width and height are substantially the same, and the markings with grooves are formed on the edges and the parts defined by them.

(vi) The grooves forming the markings have a depth no larger than 0.12 mm.

DETAILED DESCRIPTION OF THE PREFERRED EMBODIMENTS

The invention will be descried in more detail with reference to the accompanying drawings.

Figure 1:
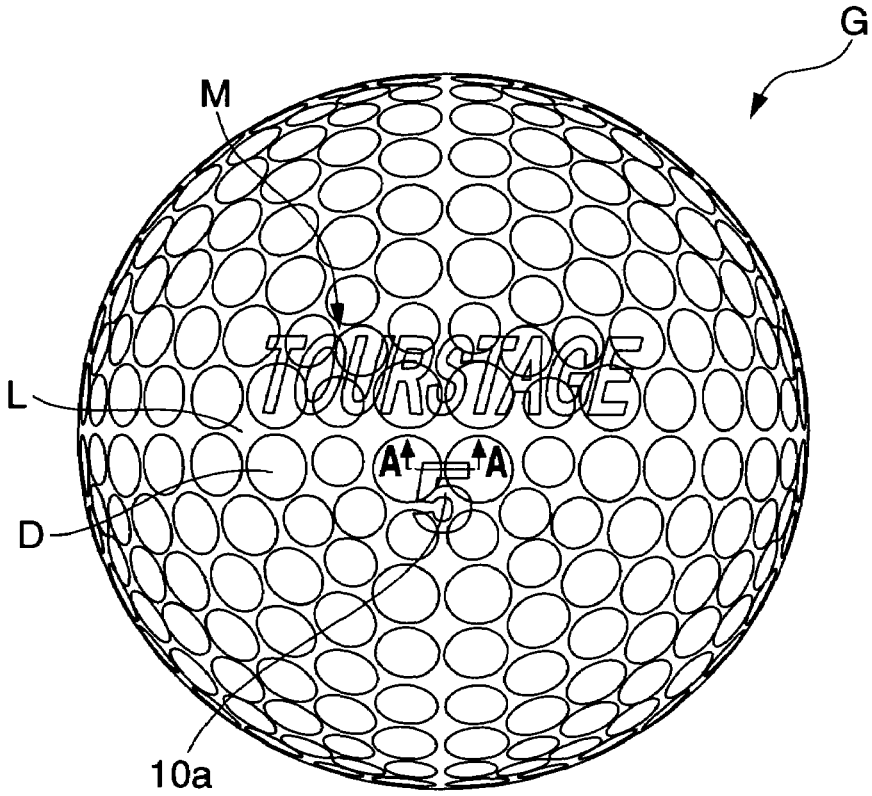
FIG. 1 is a front view showing the golf ball pertaining to the first embodiment (of the first aspect) of the present invention.
Figure 2:
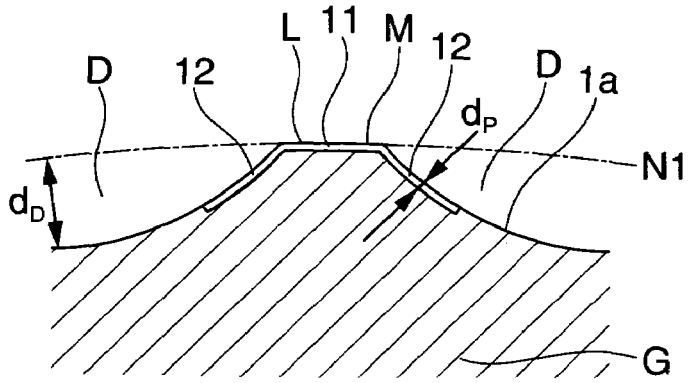
FIG. 2 is a partial sectional view A-A showing the vicinity of the surface of the golf ball shown in FIG. 1.

FIG. 1 is a front view showing the golf ball pertaining to the first embodiment (of the first aspect) of the present invention. FIG. 2 is a partial sectional view A-A showing the part of markings formed on the surface of the golf ball.

The golf ball G shown in FIG. 1 has a large number of dimples D on it surface which are formed in the usual way. The land L (which is farthermost in the radial direction from the center of the golf ball) is formed between adjacent dimples. In this embodiment, the dimples shown in FIG. 1 are circular as viewed from above; however, they may be elliptical or polygonal so long as they perform the function of dimples.

The markings M formed on the surface of the golf ball are English letters in FIG. 1. They are usually the trade name of golf ball. The numeral "5" shown in FIG. 1 represents the number of the golf ball. The markings M representing the trade name and ball number are expressed by a substantially uniform depression 10*a*, so that they can be clearly recognized by light reflection which varies between the land L and the dimple D.

According to the present invention, the depression 10*a* forming the markings M has a three-dimensional shape as shown in FIG. 2. In other words, the depression 10*a* expressing the markings M has a depth $d_p$ which is substantially uniform over the entire surface. That is, the depth $d_p$ from the surface is substantially uniform throughout the part 11 of the depression made in the land L and the part 12 of the depression made in the dimple (which extends from the land L). Incidentally, the depth $d_p$ means the depth measured in the direction normal to the curve forming the land L and the dimple D. This depth $d_p$ should preferably no larger than 0.12 mm, more preferably no larger than 0.09 mm. With the depth $d_p$ exceeding 0.12 mm, the markings might adversely affect the ball's flight performance depending on their size and arrangement on the ball's surface. The lower limit of the depth $d_p$ should preferably be 0.015 mm. On the other hand, the depth $d_D$ of the dimples is usually 0.2 to 0.4 mm. In other words, the depth $d_p$ of the depression is much smaller than the depth $d_D$ of the dimples.

Figure 3:
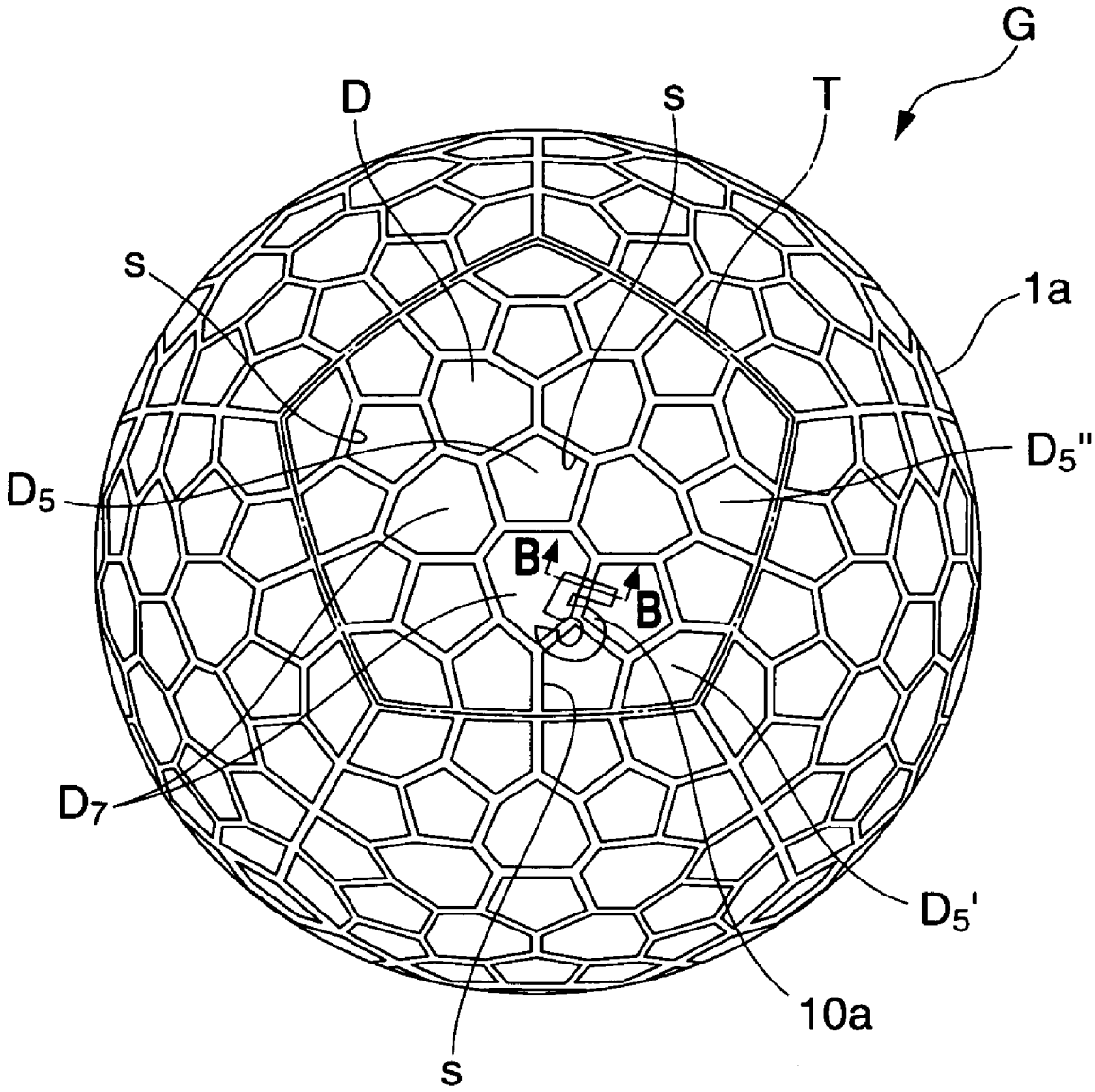
FIG. 3 is a front view showing the golf ball pertaining to the second embodiment (of the first aspect) of the present invention.
Figure 4:
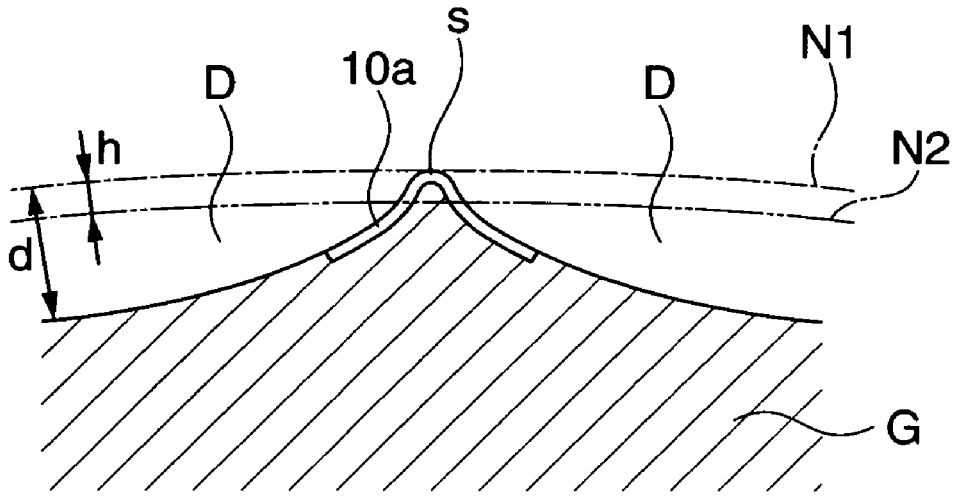
FIG. 4 is a partial sectional view B-B showing the vicinity of the surface of the golf ball shown in FIG. 3.

FIG. 3 is a front view showing the golf ball pertaining to the second embodiment (of the first aspect) of the present invention. FIG. 4 is a partial sectional view B-B showing the part of markings formed on the surface of the golf ball shown in FIG. 3.

This embodiment is characterized in that a large number of dimples D are formed on the ball's surface 1*a* such that the dimples D are defined by the edges s extending in a polygonal pattern (as viewed from above). In addition, the depression 10*a* expressing the markings is formed from one dimple to another across the edge. To be more specific, the golf ball according to this embodiment (shown in FIG. 3) has polygonal dimples D uniformly over the entire surface of the ball, with each dimple being surrounded by straight edges s. Assuming that the ball is a spherical dodecahedron, one unit pentagon T is indicated by a chain line. This unit pentagon T has 26 dimples D formed therein which differ in size, with the pentagonal dimples $D_5$ dominating. The dimples D are arranged as follows. The pentagonal dimple $D_5$ substantially similar to the unit pentagon T is placed as the center of the unit pentagon T, such that the sides of the pentagonal dimple $D_5$ are parallel to the sides of the unit pentagon T. In addition, the pentagonal dimple $D_5$ is surrounded by five heptagonal dimples $D_7$. At the vertices (or corners) of the unit pentagon T are arranged five pentagonal dimples $D_5'$ such that each of them inscribes the sides of the unit pentagon T. Moreover, three each of additional pentagonal dimples $D_5''$ are arranged between the heptagonal dimple $D_7$ and the pentagonal dimple $D_5'$ at the corner within the unit pentagon T. As the result, the unit pentagon T has therein 26 dimples in total of 21 pentagonal dimples $D_5$, $D_5'$, and $D_5''$, and five heptagonal dimples $D_7$. Thus, there are 312 pentagonal and heptagonal dimples in total over the entire surface of the golf ball.

In this embodiment shown in FIG. 4, each edge s is formed between the virtual peripheral line N1 indicated by a one-dot chain line surrounding the ball and the reference line N2 indicated by a two-dot chain line which is concentric with the virtual line N1 and inside by a distance h from the virtual line N1. The edge s has an arc-shaped cross section projecting outward from the ball's surface. The dimple D is concave inward from the reference line N2. Incidentally, a pair of parallel lines showing the edge s in FIG. 3 denote the base point of the edge crossing the reference line N2 in FIG. 4.

In this embodiment shown in FIG. 4, the depression 10*a* forming the markings M is formed over the left and right dimples D and D, with the edge s interposed between them. Incidentally, the distance h between the reference line N2 and the peripheral virtual line N1 connecting the apexes of the edges s (this distance is the height of the edge), should preferably be about 0.15 mm. The depth d of the dimple (including this distance h) should be adjusted within a range of 0.3 to 0.5 mm.

Figure 5:
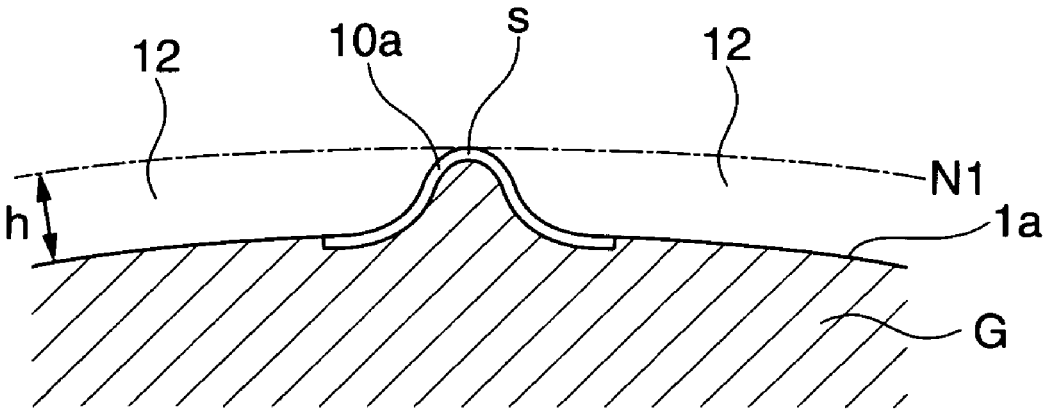
FIG. 5 is a partial sectional view showing another example of the markings formed on the surface of the golf ball.

FIG. 5 shows another embodiment pertaining to the first aspect of the present invention. The feature of the golf ball shown in FIG. 5 is that the edge s used in he above-mentioned embodiment defines polygonal or non-circular parts 12 on the ball's surface, and the depression 10*a* expressing the markings M is formed on the ball's surface 1*a* divided by the edge s. The depression 10*a* is substantially identical in structure and shape with that shown in FIGS. 3 and 4. As in FIG. 4, the peripheral virtual line M connects the apexes of the edges s; it is farthermost in the radial direction from the center of the ball and it is concentric with the outer surface corresponding to the spherical surface 1*a*.

Figure 6:
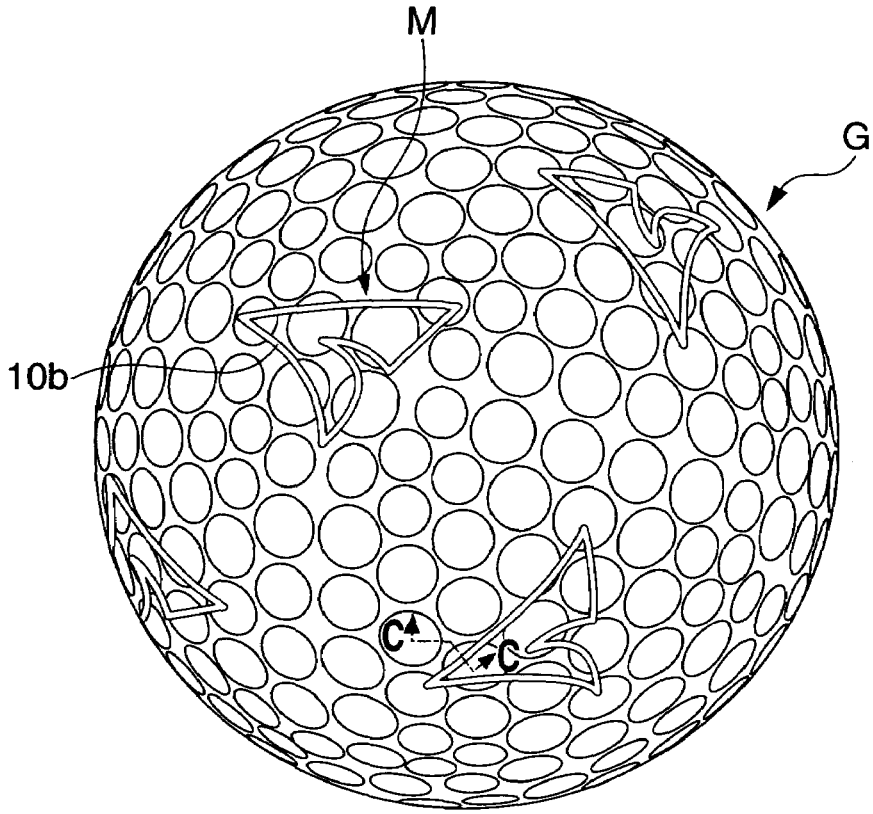
FIG. 6 is a front view showing the golf ball pertaining to the first embodiment (of the second aspect) of the present invention.
Figure 7:
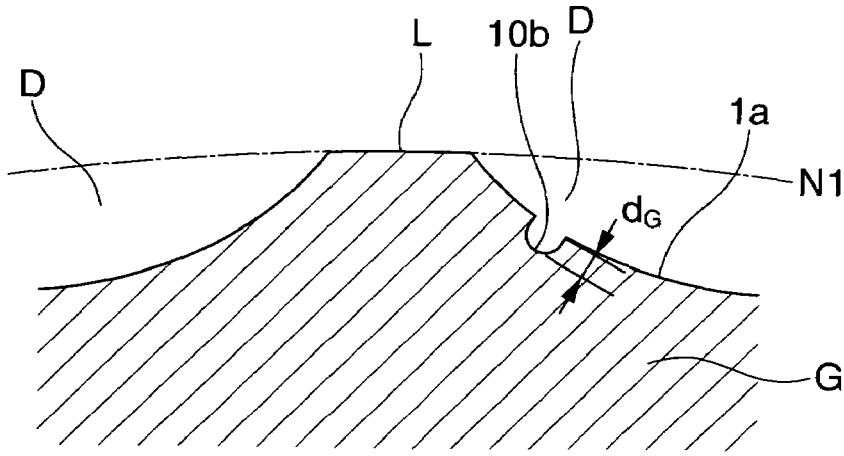
FIG. 7 is a partial sectional view C-C showing the vicinity of the surface of the golf ball shown in FIG. 6.

FIG. 6 is a front view showing the golf ball pertaining to the first embodiment (of the second aspect) of the present invention. FIG. 7 is a partial sectional view C-C showing a part of the markings M made on the surface of the ball shown in FIG. 6.

As in the first aspect of the present invention, the second aspect of the present invention is concerned with the golf ball G having the groove 10*b* expressing the markings M (letters or figures) which is formed on the ball's surface having concave parts and/or convex parts. The feature of this golf ball is that the markings M are expressed by the groove 10*b* which has a substantially uniform depth from the outer surface 1*a*.

In the example shown in FIG. 6, the V-shaped markings M are drawn by the groove 10*b*, and more than one markings M are uniformly arranged on the entire surface of the ball. The depth $d_G$ of the groove 10*b* should preferably be no larger than 0.12 mm, more preferably no larger than 0.09 mm, as in the depth of the depression 10 in the first aspect of the present invention. The lower limit should preferably be 0.015 mm. The groove 10*b* may have an arc-shaped section (as shown in FIG. 7) or a V- or U-shaped section or a polygonal section. The sectional shape is not specifically restricted. The maximum width of the groove is not specifically restricted; it may be equal to the depth or two to three times larger than the depth.

In the first and second aspects of the present invention, the groove 10*b* expressing the markings M may have a substantially uniform depth no larger than 0.012 mm. In this case it is necessary that the markings should be uniformly arranged on the ball's surface even though the grooves do not adversely affect the flight performance of the ball. This object is achieved by, for example, utilizing the known method of arrangement which regards the golf ball as a spherical icosahedron, dodecahedron, or octahedron. Arrangement in this manner provides a good appearance to the golf ball. Incidentally, the above-mentioned markings M may be formed along the equator and/or the meridian of the ball G. In this case, the markings M may be used as the target on the golf ball at the time of putting.

The markings M may be formed on the ball's surface 1*a* by injection molding that employs a cavity having concave and convex parts corresponding to the depression boa (or the groove 10*b*) and the dimples. This mold may be produced in the usual way that employs 3D-CAD or CAM, direct cutting on the cavity wall, or direct cutting on the reversal master mold.

The present invention does not exclude those golf balls which have markings thereon formed by conventional printing methods.

The golf ball according to the present invention is not limited to the shown in the above-mentioned embodiments. It may be properly changed in the shape and arrangement of dimples (and other concave and convex parts) and the kind and position of markings. It may also be changed in other construction without departing from the scope of the present invention. In addition, the golf ball according to the present invention is not specifically restricted in its structure; it may be a one-piece solid golf ball, two-piece solid golf ball, or multi-piece solid golf ball having three or more layers. The core and cover may be formed from any known thermoplastic resin or elastomer, such as rubber, ionomer resin, polyester elastomer, and urethane resin. Their thickness and hardness may be adjusted as desired. Incidentally, the total weight and diameter of the golf ball should be properly established according to the golf rules. The diameter is usually no smaller than 42.67 mm and the weight is usually no greater than 45.93 g.

As mentioned above, according to the present invention, it is possible to put markings (letters and/or figures representing trade names and numbers) on the golf ball without resorting conventional printing with ink. Such markings stay clear for a long period of time while keeping the ball's performance or without adverse effect on the ball's aerodynamic performance produced by concave and convex parts such as dimples formed on the ball's surface.

The invention claimed is:

1. A golf ball which has markings of letters or figures on its surface with concave parts and/or convex parts, wherein said markings manifest themselves as depressions in the surface having a substantially uniform depth from the surface, wherein said golf ball has a large number of dimples and the depressions are formed on the walls of the dimples and over the land existing between adjacent dimples.

2. The golf ball of claim 1, which has a large number of non-circular dimples (or concave parts) defined by edges extending with a cross section whose width and height are substantially the same, said depressions being formed on the walls of the dimples (or concave parts) and over the lands adjacent to them.

3. The golf ball of claim 1, wherein the depressions forming the markings have a depth no larger than 0.12 mm.

4. The golf ball of claim 1, wherein the markings are formed on the surface by injection molding that employs a cavity having a concave and convex parts corresponding to the depressions and dimples.

5. A golf ball which has markings of letters or figures on its surface with concave parts and/or convex parts, wherein said markings manifest themselves as grooves in the surface having a substantially uniform depth from the surface, wherein said golf ball has a large number of dimples, with the markings with grooves being formed on the walls of the dimples and over the land existing between adjacent dimples.

6. The golf ball of claim 5, which has a large number of non-circular dimples (or concave parts) defined by edges extending with a cross section whose width and height are substantially the same, with the markings with grooves being formed on the edges and the parts defined by them.

7. The golf ball of claim 5, wherein the grooves forming the markings have a depth no larger than 0.12 mm.

8. The golf ball of claim 5, wherein the markings are formed on the surface by injection molding that employs a cavity having concave and convex parts corresponding to the grooves and the dimples.

* * * * *